US011492721B2

(12) United States Patent
Tsuji et al.

(10) Patent No.: US 11,492,721 B2
(45) Date of Patent: Nov. 8, 2022

(54) ELECTROPLATING APPARATUS AND CLEANING METHOD IN ELECTROPLATING APPARATUS

(71) Applicant: EBARA CORPORATION, Tokyo (JP)

(72) Inventors: Kazuhito Tsuji, Tokyo (JP); Mizuki Nagai, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 377 days.

(21) Appl. No.: 15/947,317

(22) Filed: Apr. 6, 2018

(65) Prior Publication Data

US 2018/0291521 A1 Oct. 11, 2018

(30) Foreign Application Priority Data

Apr. 7, 2017 (JP) ..... JP2017-076781

(51) Int. Cl.

| | |
|---|---|
| ***C25D 17/06*** | (2006.01) |
| ***B08B 3/08*** | (2006.01) |
| ***C25D 17/00*** | (2006.01) |
| ***C25D 21/08*** | (2006.01) |
| ***B08B 3/04*** | (2006.01) |

(52) U.S. Cl.

CPC ..... *C25D 17/06* (2013.01); *B08B 3/04* (2013.01); *B08B 3/08* (2013.01); *C25D 17/00* (2013.01); *C25D 17/001* (2013.01); *C25D 17/005* (2013.01); *C25D 21/08* (2013.01)

(58) Field of Classification Search

CPC ..... C25D 17/00; C25D 17/001; C25D 17/02–17/04; C25D 17/06–17/08; C25D 21/00; C25D 21/08

See application file for complete search history.

(56) References Cited

U.S. PATENT DOCUMENTS 9,309,603 B2 * 4/2016 Woodruff ..... C25D 17/004
9,574,283 B2 * 2/2017 Arvin ..... C25F 3/02

(Continued)

FOREIGN PATENT DOCUMENTS

JP S47-006425 Y 3/1972
JP 56087698 A * 7/1981

(Continued)

OTHER PUBLICATIONS

Google Patent translation of JP 2008045179 A (Year: 2020).*

(Continued)

*Primary Examiner* — Alexander W Keeling
(74) *Attorney, Agent, or Firm* — BakerHostetler

(57) ABSTRACT

The agitation of the plating solution may result in spattering of the plating solution. It have been found that the spattered plating solution can be attached even to portions that are not originally brought into contact with the plating solution in the plating apparatus. There is provided an electroplating apparatus for plating a substrate using a substrate holder, the electroplating apparatus comprising at least one bath for storing the substrate, the substrate holder being provided with a hanger shoulder, and a holder contact, and wherein the electroplating apparatus being provided with a cleaning/drying part provided on at least one side of the bath, the cleaning/drying part being provided for cleaning and/or drying at least one of the hanger shoulder, the holder contact and a contact provided to the bath.

7 Claims, 13 Drawing Sheets

(56) References Cited

U.S. PATENT DOCUMENTS

| | | | | |
|---|---|---|---|---|
| 2002/0006876 | A1* | 1/2002 | Hongo | H01L 21/67051 156/345.12 |
| 2014/0020720 | A1 | 1/2014 | Fujikata et al. | |
| 2014/0097088 | A1* | 4/2014 | Stowell | C25D 5/22 205/99 |
| 2017/0056934 | A1* | 3/2017 | Wang | C25D 21/08 |

FOREIGN PATENT DOCUMENTS

| | | | | |
|---|---|---|---|---|
| JP | 2008045179 | A | * | 2/2008 |
| JP | 2014-019900 | A | | 2/2014 |
| KR | 2008-0040375 | A | | 5/2008 |
| KR | 20080040375 | A | * | 5/2008 |
| TW | 201708625 | A | | 3/2017 |

OTHER PUBLICATIONS

Merriam-Webster ("Shoulder", 2020). (Year: 2020).*
JP 56087698 A, Espacenet translation and Derwent abstract (Year: 2020).*
KR-20080040375-A Google Translation (Year: 2021).*

* cited by examiner

ELECTROPLATING APPARATUS AND CLEANING METHOD IN ELECTROPLATING APPARATUS

TECHNICAL FIELD

The present application relates to an electroplating apparatus and a cleaning method in the electroplating apparatus.

BACKGROUND ART

One of semiconductor manufacturing apparatuses includes a plating apparatus which forms metal interconnect lines on a surface of a substrate (which wires metal on a surface of a substrate). In a method called an electroplating method, a substrate is immersed in a plating solution, and electric and chemical reactions are caused on the surface of the substrate to thereby plate metal in the plating solution on the substrate. A typical plating apparatus is provided with a substrate holder to support the substrate to be plated.

Some part of the substrate holder may be immersed in the plating solution together with the substrate. If such a substrate holder is used, the metal in the plating solution may be deposited on a part of the substrate holder that is immersed in the plating solution. The metal deposited on the substrate holder may influence the plating quality. Thus, there have been known plating apparatuses that clean a part of the substrate holder that is immersed in the plating solution. For example, in PTL 1 there is disclosed a plating apparatus that cleans a sealing member for sealing a peripheral portion of the surface of the substrate.

CITATION LIST

Patent Literature

PTL 1: Japanese Patent Laid-Open No. 2014-19900

SUMMARY OF INVENTION

Technical Problem

There exists a plating apparatus that is provided with a paddle and/or a circulation pump for agitating the plating solution to maintain uniformity of the plating solution. The agitation of the plating solution by means of the paddle and/or the circulation pump may result in spattering (scattering) of the plating solution. It has been found that the spattered plating solution can be attached even to portions in the plating apparatus that are not originally brought into contact with the plating solution. In PTL 1, it is not assumed that the plating solution is spattered, and therefore it is difficult to clean the portions to which the plating solution is attached, in the plating apparatus of PTL 1.

The present application has been made to solve at least some of the above problems. It is an object of the present application to provide an electroplating apparatus and a cleaning method in the electroplating apparatus.

Solution to Problem

The present application discloses, as one embodiment, an electroplating apparatus for plating a substrate using a substrate holder, the electroplating apparatus comprising at least one bath for storing the substrate, the substrate holder being provided with a hanger shoulder, and a holder contact, and the electroplating apparatus being provided with a cleaning/drying part provided on at least one side portion of the bath, the cleaning/drying part being provided for cleaning and/or drying at least one of the hanger shoulder, the holder contact and the contact provided to the bath.

DESCRIPTION OF EMBODIMENTS

First Embodiment

Figure 1:
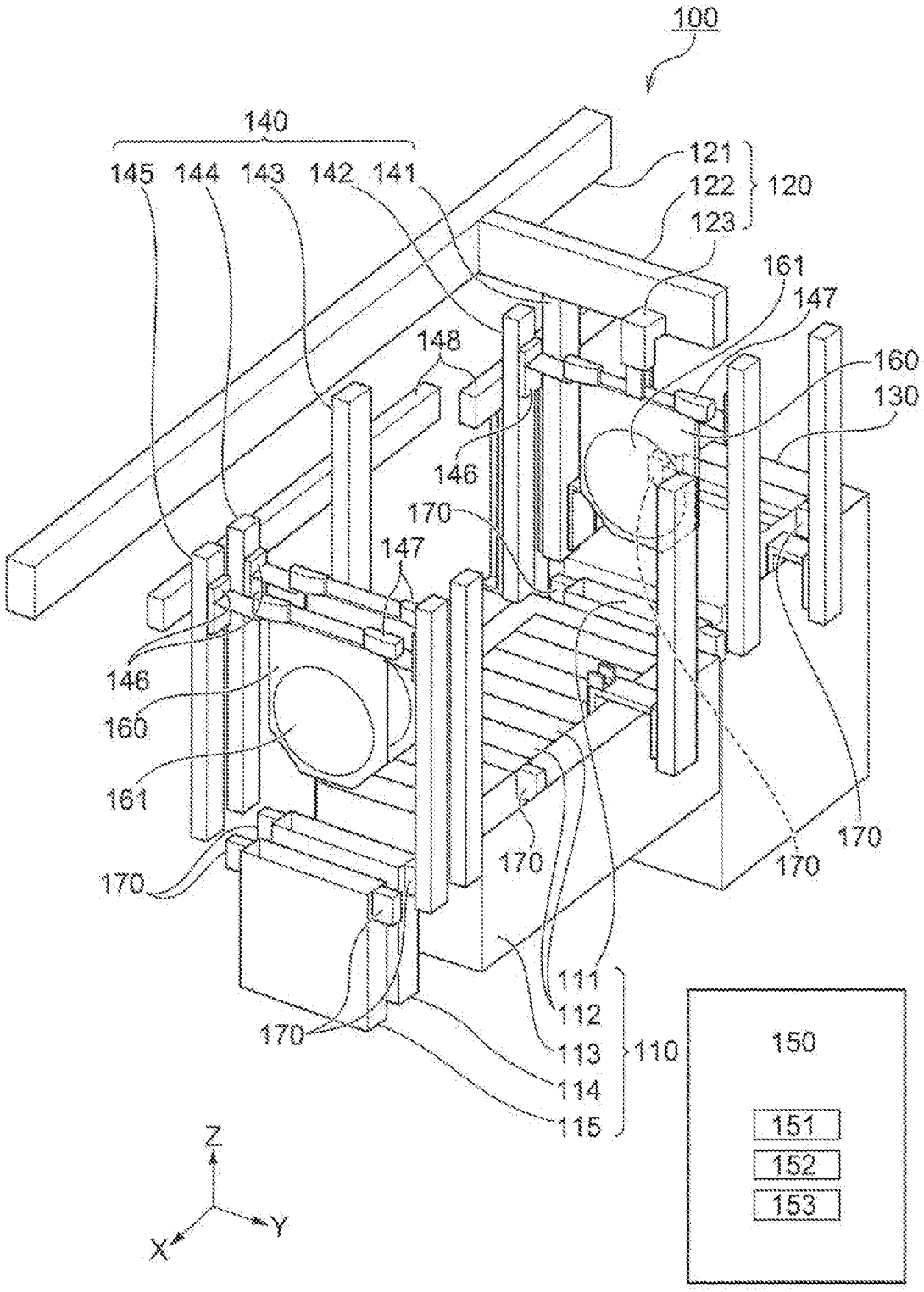
FIG. 1 is a perspective view illustrating a main part of a plating apparatus.

FIG. 1 is a perspective view illustrating a main part of a plating apparatus 100 according to a first embodiment. The plating apparatus in FIG. 1 is described as an electroplating apparatus, but may be a plating apparatus other than the electroplating apparatus. The plating apparatus 100 in FIG. 1 is largely divided into (1) a bath group 110 provided with a plating bath 112 and the like, (2) a transport mechanism 120 provided with a transport guide 121 and the like, (3) a stocker 130 for storing a substrate holder 160, (4) a lifter group 140 for lifting and lowering a substrate 161, (5) a control part 150 for controlling various components, and the like. A form of the plating apparatus 100, however, is not limited to a form illustrated in FIG. 1, and components may be added, removed, or replaced. For example, the plating apparatus 100 may include a mechanism for loading the substrate from the outside of the apparatus. For the purpose of convenience of description, hereinafter, it is assumed that a blowing bath 115 (a portion where the blowing bath 115 is locating) defines a front of the plating apparatus 100, and the stocker 130 (a portion where the stocker 130 is locating) is defining back (rear) of the plating apparatus 100. Hereinafter, the term "right side/part/portion/direction, etc." should be understood as a right (the positive direction of Y axis in FIG. 1), side/part, etc. when viewed from the front of the plating apparatus 100. Also hereinafter, the term "left side/part/portion/direction, etc." should be understood as a left (the negative direction of Y axis in FIG. 1), side/part, etc. when viewed from the front of the plating apparatus 100.

The bath group 110 in the present embodiment includes a pre-cleaning bath 111, a plating bath 112, an overflow bath 113, a rinsing bath 114, and a blowing bath 115. The pre-cleaning bath 111 is configured to clean the substrate 161 held by the substrate holder 160 with pure water prior to the plating of the substrate 161. The plating bath 112 is configured to plate the substrate 161, and be supplied with a plating solution through piping (not illustrated) or the like. The overflow bath 113 is disposed around the plating bath 112, so that the plating solution that has overflowed the plating bath 112 is received by the overflow bath 113. The rinsing bath 114 is configured to clean the plated substrate 161 with pure water. The blowing bath 115 is configured to eject gas (dried air, dry nitrogen or the like) toward the substrate 161 cleaned in the rinsing bath 114 to thereby dry the substrate 161. The "drying" as used herein, however, is not limited to removing the liquid completely. Each bath in the bath group 110 has a rectangular parallelepiped shape having an opening in a top portion thereof, but the shape of the bath is not limited to this shape. The pre-cleaning bath 111, the plating bath 112, the rinsing bath 114, and the blowing bath 115 are disposed in a state aligned in an X-axis direction in FIG. 1.

In an example of FIG. 1, there are provided a plurality of plating baths 112. Each of the plating baths 112 includes an anode 302, a regulation plate 303, a paddle 304, a circulation pump 305, and a plating bath contact 306 that are described in detail in FIG. 3 (for the purpose of convenience of illustration, these components are not illustrated in FIG. 1).

The transport mechanism 120 of the present embodiment is configured to transport the substrate holder 160 between the stocker 130 and each bath. Since the substrate holder 160 can hold the substrate 161, it can be also said that the transport mechanism 120 is configured to transport the substrate 161. The transport mechanism 120 includes the transport guide 121, a transport arm 122, and a holder gripping mechanism 123. The transport guide 121 is provided a position higher than the bath group 110 and lateral to the bath group 110. The transport mechanism 120 enables the transport arm 122 to be moved in the X-axis direction in FIG. 1 along the transport guide 121 by means of a drive mechanism (not illustrated). The holder gripping mechanism 123 is configured to detachably grip the substrate holder 160, and is provided to the transport arm 122. The holder gripping mechanism 123 may be configured to grip a plurality of substrate holders 160.

The holder gripping mechanism 123 of FIG. 1 holds the substrate 161 so that a direction perpendicular to a surface of the substrate 161 coincides with the transport direction (briefly stated, the holder gripping mechanism 123 of FIG. 1 hangs the substrate laterally). Alternatively, the holder gripping mechanism 123 may hold the substrate 161 so that the direction perpendicular to the surface of the substrate 161 coincides with the vertical direction (briefly stated, the holder gripping mechanism 123 may hold the substrate horizontally). In this case, the columnar baths or the bowl-shaped baths may be used.

The stocker 130 in the present embodiment is provided on the back of the pre-cleaning bath 111, and can store one or a plurality of substrate holders 160. The substrate holder 160 may be stored in the stocker 130 in a state of holding the substrate 161, or in a state of not holding the substrate 161. The stocker 130 may be herein expressed as a "bath" for the purpose of convenience of description.

The lifter group 140 in the present embodiment includes a lifter 141 for a storage, a lifter 142 for a pre-cleaning bath, a lifter 143 for a plating bath, a lifter 144 for a rinsing bath, and a lifter 145 for a blowing bath. Each of the lifters is provided with a lifter arm 146. Each lifter enables the lifter arm 146 to be moved in the vertical direction (Z-axis direction in FIG. 1) by means of a drive mechanism (not illustrated). The lifter arm 146 is provided with a receiver 147 for receiving the substrate holder 160 from the transport mechanism 120. The substrate 161 held by the substrate holder 160 can be stored in each bath or removed from each bath by lifting and lowering the lifter arm 146.

In a typical plating apparatus 100, the stocker 130 stores the plurality of substrate holders 160, and a plurality of plating baths 112 are provided. It is preferable that the lifter 141 for a stoker and the lifter 143 for a plating bath are movable in the X-axis direction in FIG. 1 to select the substrate holder 160 to be extracted and to select the plating bath 112 to store the substrate 161. In an example of FIG. 1, each of the lifter 141 for a stocker and the lifter 143 for a plating bath is configured to be movable along the lifter guide 148. For the purpose of convenience of illustration, the lifter guide locating right of the plating apparatus 100 is not illustrated in FIG. 1.

The control part 150 in the present embodiment includes a control device 151, a storage device 152, an input device 153, and a display device (not illustrated) or the like. The control part 150 is connected to various components of the plating apparatus 100, and controls the transport and plating of the substrate 161.

Figure 2:
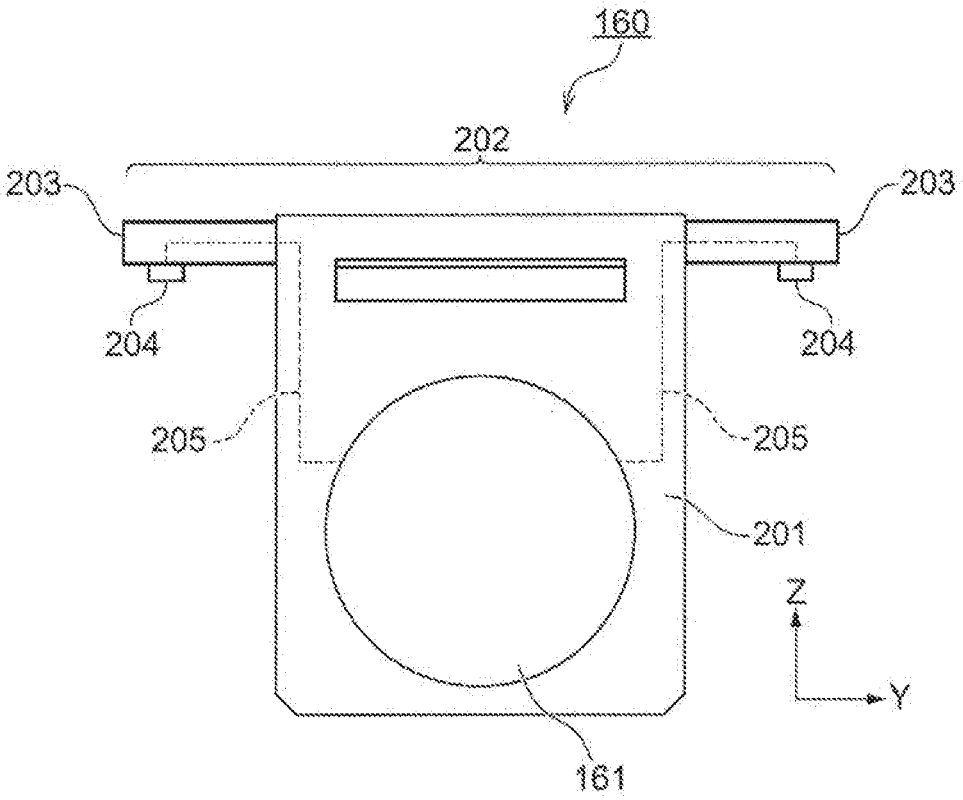
FIG. 2 is an elevational view illustrating a substrate holder.

A structure of the substrate holder 160 will be described below. FIG. 2 is an elevational view illustrating the substrate holder 160 of the plating apparatus 100 according to the present embodiment. Note that the substrate holder 160 illustrated in FIG. 2 is simplified, and the substrate holder may be in a form other than that illustrated. For example, the substrate holder 160 for holding a plurality of substrates 161 may be used.

The substrate holder 160 includes a holding part 201 for holding the substrate 161. The substrate holder 160 further includes a hanger part 202 for being gripped by the holder gripping mechanism 123 of the transport mechanism 120. A width of the hanger part 202 is larger than the width of the holding part 201. Thus, both ends of the hanger part 202 project rightward and leftward from the holding part 201, and each of the protruded portion constitutes a hanger shoulder 203, respectively. Both of the hanger shoulders 203 are supported by receivers 147 of each lifter so that each lifter can receive the substrate holder 160.

A holder contact 204 is provided on a bottom of one or both of the hanger shoulders 203, and a conductive wire 205 is wired between the holder contact 204 and the substrate 161. A voltage required for electroplating the substrate 161 is applied to the substrate 161 from the holder contact 204 through the conductive wire 205.

When the substrate 161 held by such a substrate holder 160 is immersed in the plating solution, a part of the holding part 201 (at least part lower than the uppermost portion of the substrate 161) is also immersed in the plating solution. The metal in the plating solution is possibly deposited on a part of the holding part 201 that is immersed in the plating solution. If the metal is deposited on a sealing member (not illustrated) for sealing a peripheral portion of a surface of the substrate 161, for example, it may cause poor in-plane uniformity of a plating film, and leakage of the plating solution. Therefore, there has been known a plating apparatus capable of cleaning a part of a substrate holder that is immersed in a plating solution. Note that examples of plating metals contained in the plating solution include copper, tin-silver alloy, aluminum-silver alloy, nickel, gold, tin, and palladium.

On the other hand, even if the substrate 161 held by the substrate holder 160 is immersed in the plating solution, the hanger part 202 of the substrate holder 160 is not immersed in the plating solution. In other words, the hanger part 202 is not originally brought into contact with the plating solution. However, it has been found that the spattered plating solution can be attached even to the hanger part 202 and the like during the plating of the substrate 161.

Figure 3:
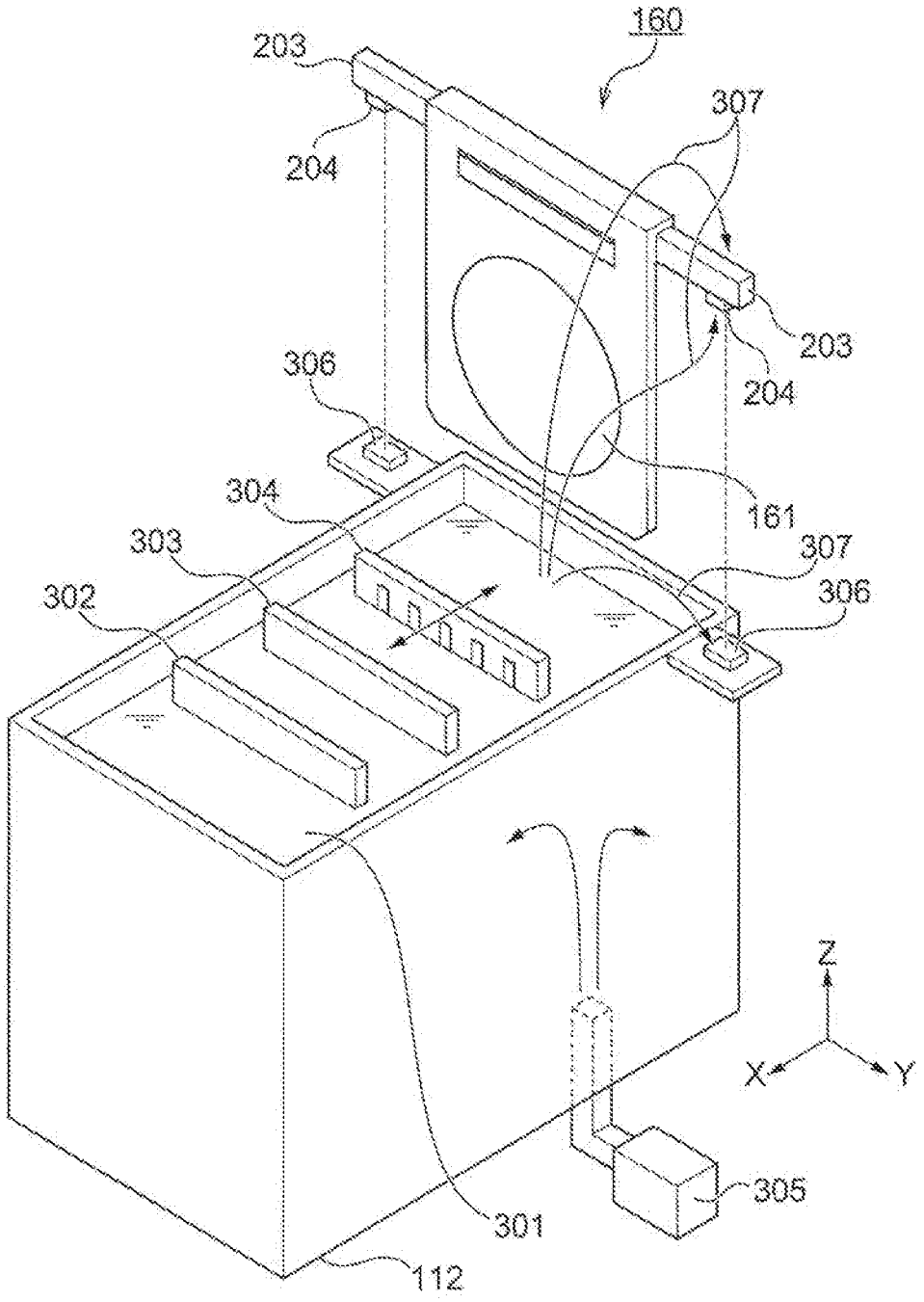
FIG. 3 is a perspective view illustrating a plating bath (tank) for explaining spattering of a plating solution.

FIG. 3 is a perspective view illustrating the plating bath 112 for explaining spattering of a plating solution 301. The dimension and aspect ratio of each component in FIG. 3 do not necessarily coincide with the dimension and aspect ratio of actual component.

The plating solution 301 is supplied into the plating bath 112. FIG. 3 illustrates an example in which the plating solution 301 does not reach the uppermost edge of the plating bath 112 (the plating solution 301 does not overflow the plating bath 112). When the plating apparatus 100 is provided with the overflow bath 113, the plating solution 301 may reach the uppermost edge of the plating bath 112 (the plating solution 301 may overflow the plating bath 112).

The anode 302, the regulation plate 303, and the paddle 304 are provided in the plating bath 112, and these components are immersed in the plating solution 301. The anode 302 is connected to a power source (not illustrated). A voltage is applied between the anode 302 and the substrate 161 to thereby plate the substrate 161. The regulation plate 303 is a member for regulating a potential distribution on the substrate 161 when the substrate 161 is plated. The paddle 304 has openings therein, is formed in a plate-like shape, and can be moved parallel to the X-axis direction by means of a drive mechanism (not illustrated) in FIG. 3 or the like. The circulation pump 305 for circulating the plating solution 301 is connected to the bottom of the plating bath 112. The plating bath contact 306 is provided on at least one of the left side portion and the right side portion of the plating bath 112. The plating bath contact 306 is configured to be electrically connected to the holder contact 204 when the substrate holder 160 is stored in the plating bath 112. Note that a configuration of the plating bath 112 is not limited to the configuration illustrated in FIG. 3. For example, a paddle having the other shape (a rod shape) may be used as the paddle 304. The moving direction of the paddle 304 is not limited to the X-axis direction. The connection position of the circulation pump 305 may be a side portion of the plating bath 112.

The control device 151 of the plating apparatus 100 controls the paddle 304 and/or the circulation pump 305 to agitate the plating solution 301 in order to maintain uniformity of the plating solution 301 during the plating of the substrate 161. The agitation of the plating solution 301 by means of the paddle 304 and/or the circulation pump 305 may result in spattering of the plating solution 301. The plating solution 301 may be spattered not only when the plating solution 301 is agitated but also when the substrate 161 is being immersed in the plating solution 301. It was found that droplets 307 which are the spattered plating solution can be attached even to portions such as the hanger shoulder 203, the holder contact 204, and the plating bath contact 306 that are not originally brought into contact with the plating solution. Note that the size of the "droplets" as used herein is not limited, and the "droplets" may be shaped like raindrop or mist.

When the droplets 307 are attached to the contact (the holder contact 204 or the plating bath contact 306), an electric resistance value of the contact deviates from a predetermined value, resulting in possibly varying a current supplied to the substrate and/or a voltage applied to the substrate, for example. The plating quality in the electroplating (the in-plane uniformity of a plating film thickness, in particular) is influenced by the electric conditions during the plating of the substrate. It is preferable to maintain the contact in a cleaned state to perform the plating in a stable manner.

The influence of the droplets 307 attached to the hanger shoulder 203 on the current and/or the voltage is considered smaller than the influence of the droplets 307 attached to the contact on the current and/or the voltage. However, when the moisture in the droplets 307 is dried, the metals in the droplets 307 may be deposited on the hanger shoulder 203. The deposited metals may peel off the hanger shoulder, thereby possibly becoming particles on the contact or the substrate 161. The particles on the contact can vary the electric resistance value of the contact, for example. The particles on the substrate 161 may cause a plating defect, for example. It is preferable to maintain not only the contact but also the hanger shoulder 203 in a cleaned state to perform the plating in a stable manner.

When a contact is provided to the bath other than the plating bath 112, the droplets 307 may be attached to the contact of the bath other than the plating bath 112 if the droplets 307 vigorously spatter from the plating bath 112. In this case, the droplets 307 may influence the processing performed in the bath other than the plating bath 112. In the specification, the plating bath contact 306 and the contacts provided to the baths other than the plating bath 112 are collectively referred to as "contacts provided to the baths."

There has not been known a plating apparatus for cleaning the hanger shoulder 203, the holder contact 204, and the contacts provided to the baths. In the conventional electroplating apparatus, these parts are manually cleaned by removing the substrate holder 160 from the plating apparatus, thereby causing reduced throughput of the plating apparatus. If these parts can be cleaned without removing the substrate holder 160 from the plating apparatus, the plating can be performed in a stable manner without reducing the throughput of the plating apparatus.

When the hanger shoulder 203 and the like are manually cleaned, the hanger shoulder 203 and the like cannot always be cleaned immediately after the droplets 307 are attached to the hanger shoulder 203 and the like. Thus, the moisture in the droplets 307 evaporates during a period from attachment of the droplets 307 to the cleaning of the hanger shoulder 203, thereby possibly depositing metals in the droplets 307 on the hanger shoulder 203 and the like. Cleaning of the deposited metals is more difficult and requires more time and labor than cleaning of the droplets 307. Therefore, it is preferable that the time period from attachment to cleaning of the droplets 307 is shorter.

When the current flows in the contacts such as the plating bath contacts 306 or the contacts provided to the baths to which the droplets 307 are attached, the metals in the droplets 307 may be plated on these contacts. The metals deposited on the contacts by plating are firmly attached to the contacts. Thus, the metals deposited on each contact may not be sufficiently cleaned with pure water, and the other type of cleaning liquid may be required. Therefore, it is preferable that the cleaning liquid other than pure water can be used according to the cleaning purpose and the portion to be cleaned.

The plating apparatus 100 in the present embodiment includes a cleaning/drying part 170 for cleaning and/or drying the holder contact 204. The cleaning/drying part 170 is provided on at least one side portion of at least one bath of the pre-cleaning bath 111, the plating bath 112, the rinsing bath 114, and the blowing bath 115 (in FIG. 1, all of the above-described baths are provided with the cleaning/drying part 170). When the holder contact 204 is provided on each of bottoms of the left and right hanger shoulders 203, it is preferable to provide the cleaning/drying part 170 to each of both left and right side portions of each bath. If the plating apparatus 100 includes a bath other than the above-described baths, the cleaning/drying part 170 may be provided with the bath. The cleaning/drying part 170 may be provided in the side portion of the stocker 130.

Figure 4:
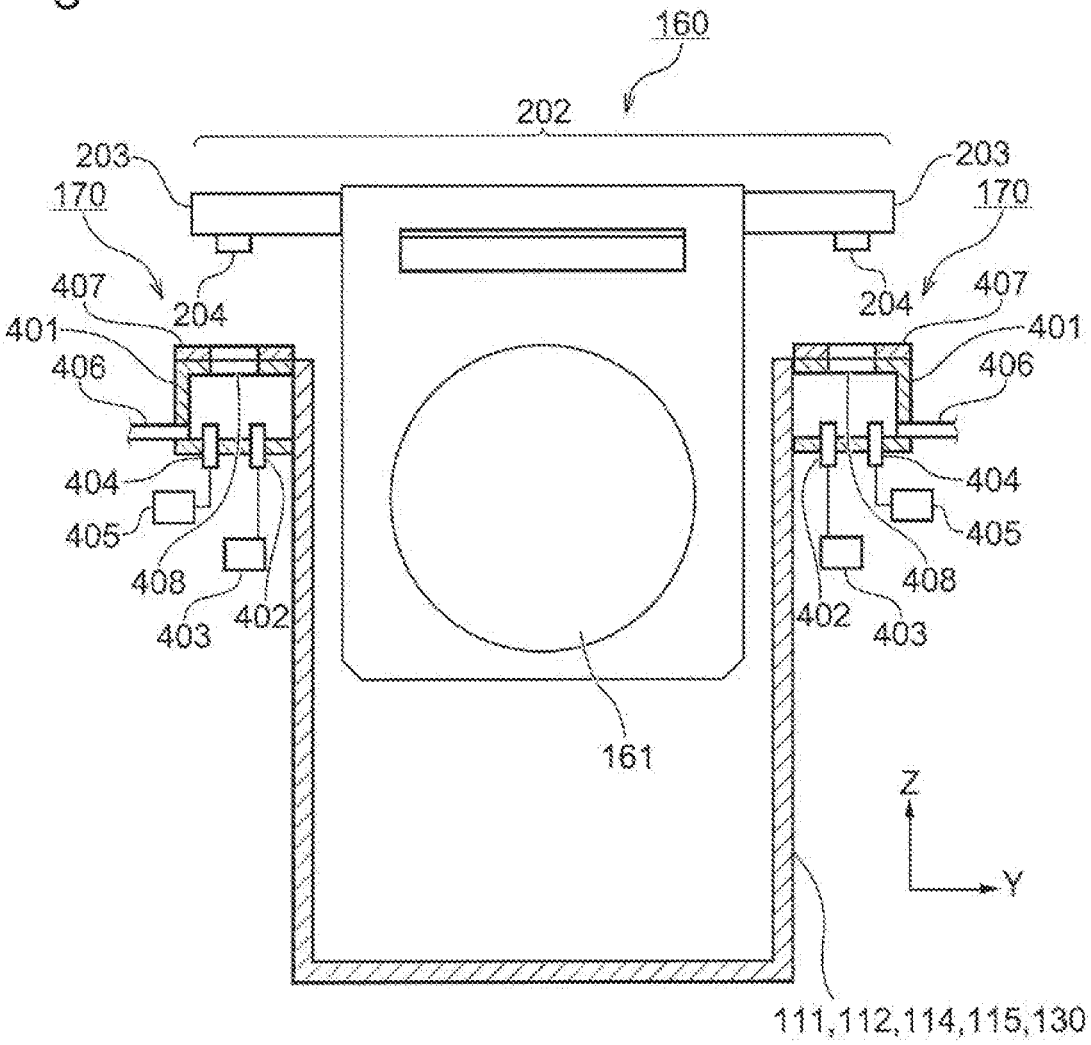
FIG. 4 is an elevational view (partial cross-sectional view) illustrating a bath provided with a cleaning/drying part for cleaning and/or drying a holder contact.

The cleaning/drying part 170 will be described in detail using FIG. 4. FIG. 4 is an elevational view (partial cross-sectional view) illustrating a bath provided with the cleaning/drying part 170 for cleaning and/or drying the holder contact 240. FIG. 4 illustrates a cross-section of the bath and the cleaning/drying part 170. As described above, the bath may be the pre-cleaning bath 111, the plating bath 112, the rinsing bath 114, the blowing bath 115, the stocker 130, or the other bath.

The cleaning/drying part 170 in FIG. 4 includes a cleaning/drying box 401, an opening 402 for cleaning, a cleaning liquid supplying device 403, an opening 404 for drying, a gas discharge/suction device 405, and a discharge port 406, and a hanger shoulder supporter 407. The opening 402 for cleaning and the opening 404 for drying are provided on the cleaning/drying box 401. The cleaning/drying box 401 has an upper opening 408 on the top. The upper opening 408 is provided at a position corresponding to that of the holder contact 204 when the substrate holder 160 is stored in the bath.

The cleaning liquid supplying device 403 is configured to supply cleaning liquid into the cleaning/drying box 401 through the opening 402 for cleaning. As a method of supplying the cleaning liquid, the cleaning liquid may be injected from the opening 402 for cleaning that is formed into a nozzle shape. In this case, it is preferable to inject (to squirt, to spray, to spurt) the cleaning liquid toward the upper opening 408. If the cleaning liquid is not injected, it is preferable to configure the cleaning liquid supplying device 403 to fill the cleaning liquid in the cleaning/drying box 401. In this case, it is preferable that the cleaning/drying box 401 is configured to provide the opening 402 for cleaning at a lower portion than the upper opening 408, so that excess cleaning liquid flows into the overflow bath 113. The type of cleaning liquid may be arbitrary, and pure water, a volatile solvent (alcohols, or the like), or etching liquid (sulfuric acid/hydrogen peroxide based etching liquid, or the like), for example, may be used as the cleaning liquid. When the etching liquid is used as the cleaning liquid, the metal components (copper and the like) can be removed with the etching liquid even when the metal components in the plating solution are deposited on the holder contact and the plating bath contact.

The gas discharge/suction device 405 is configured to discharge or suck the gas to/from the inside of the cleaning/drying box 401 through the opening 404 for drying. The type of gas to be discharged may be arbitrary, and dried air, dry nitrogen or the like, for example may be used.

The discharge port 406 is configured to discharge the cleaning liquid in the cleaning/drying box 401. The "discharge port" as used herein may be provided with an opening and closing mechanism such as a valve so that the discharge of the cleaning liquid can be controlled. The hanger shoulder supporter 407 is provided on the upper portion of the cleaning/drying box 401 to support the hanger shoulder 203 of the substrate holder 160.

Figure 5:
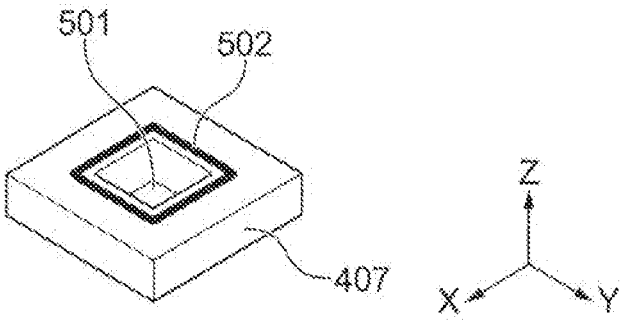
FIG. 5 is a perspective view of a hanger shoulder supporter.

FIG. 5 is a perspective view of the hanger shoulder supporter 407. The hanger shoulder supporter 407 has a supporter opening 501 that communicates with the upper opening 408. By the upper opening 408 and the supporter opening 501, when the hanger shoulder supporter 407 supports the hanger shoulder 203, the holder contact 204 is exposed to the inside of the cleaning/drying box 401. This configuration enables the holder contact 204 to be cleaned with the cleaning liquid in the cleaning/drying box 401. A packing 502 is provided to cover a periphery of the supporter opening 501, thereby capable of preventing the cleaning liquid from leaking from a gap between the supporter opening 501 and the hanger shoulder 203. The cover may be provided to the periphery of the hanger shoulder supporter 407 in preparation for the case that the cleaning liquid leaks.

The cleaning liquid supplying device 403 is configured to supply the cleaning liquid into the cleaning/drying box 401 in a state where the hanger shoulder 203 is supported by the hanger shoulder supporter 407. The supplied cleaning liquid is brought into contact with the holder contact 204 to thereby remove the droplets 307 attached to the holder contact 204, so that the cleaning of the holder contact 204 is achieved. The control device 151 may be configured to control the cleaning liquid supplying device 403 to automatically clean the holder contact 204.

When the cleaning liquid is injected from the opening 402 for cleaning, the cleaning effect of the holder contact 204 can be enhanced by kinetic energy of the cleaning liquid. An amount of cleaning liquid to be used can be reduced as compared with a case where the cleaning liquid is filled in the cleaning/drying box 401.

When the cleaning liquid is filled in the cleaning/drying box 401, the amount of cleaning liquid with respect to adhesion amount of droplets 307 is increased as compared with a case where the cleaning liquid is injected, and the dilution degree of the droplets 307 is increased. Thus, the cleaning effect of the holder contact 204 can be enhanced. The cleaning/drying box 401 may be configured so that excess cleaning liquid overflows the cleaning/drying box. For example, the cleaning/drying box 401 can be configures so that excess cleaning liquid flows into the overflow bath 113. As another example, the cleaning/drying box can be formed into a double structure so that the cleaning liquid is supplied into an inner bath, and excess cleaning liquid flows from the inner bath to an outer bath. The cleaning/drying box is configured so that the cleaning liquid overflows, thereby capable of preventing the droplet 307 removed from the holder contact 204 from staying in the cleaning/drying box 401. In other words, the droplets 307 diluted with the cleaning liquid can be prevented from being attached to the holder contact 204 again. Furthermore, it is preferable to provide the opening 402 for cleaning at a lower portion than the upper opening 408 (a bottom surface of the cleaning/drying box 401, in particular). This configuration enables the cleaning liquid containing no components of droplets 307 to flow toward the upper opening 408 (that is, toward the holder contact 204), thereby capable of enhancing the cleaning effect of the holder contact 204.

Subsequently to the cleaning of the holder contact 204, the gas discharge/suction device 405 is configured to discharge or suck the gas in a state where the hanger shoulder 203 is supported by the hanger shoulder supporter 407. When the gas is discharged, the cleaning liquid is removed by injecting the gas to the holder contact 204. When the gas is sucked, the cleaning liquid evaporates by placing the holder contact 204 in a reduced pressure environment. The drying of the holder contact 204 is achieved by either method. The control device 151 may be also configured to control the gas discharge/suction device 405 so that the holder contact 204 is automatically dried. If the drying of the holder contact 204 is not required (if only cleaning is performed), it is not required to provide the opening 404 for drying and the gas discharge/suction device 405.

The cleaning/drying part 170 may be configured to clean the holder contact 204 without removing the substrate holder 160 from the plating apparatus. Thus, the plating apparatus 100 of the present embodiment can clean the holder contact 204 without reducing the throughput of the plating apparatus, thereby maintaining the holder contact 204 in a cleaned state, and performing the plating in a stable manner. Furthermore, in the plating apparatus 100 of the present embodiment, the time period from attachment of the droplets 307 to cleaning of the holder contact 204 can be shorter as compared with that of the conventional plating apparatus.

When the cleaning/drying part 170 is provided to the plating bath 112, the time period from attachment of the droplets 307 to cleaning of the holder contact 204 can become the shortest. Note that as illustrated in FIG. 3, the plating bath 112 is provided with various mechanisms, and a space for installing the cleaning/drying part 170 may be insufficient. In this case, it is preferable that the cleaning/drying part 170 is provided to the rinsing bath 114 or the blowing bath 115 in which the substrate holder 160 is stored after being removed from the plating bath 112.

The cleaning/drying part 170 that has both of a cleaning function and a drying function may be provided to only any one of the rinsing bath 114 and the blowing bath 115. However, in this case, a state where the drying of the holder contact 204 is not completed may occur in spite of the rinsing of the substrate 161 being completed. In this case, since it is necessary to wait for the completion of the drying of the holder contact 204, the throughput of the plating may be reduced. Thus, it is preferable the cleaning/drying part 170 having a cleaning function is provided to the rinsing bath 114, and the cleaning/drying part 170 having a drying function is provided to the blowing bath 115. According to this configuration, the rinsing of the substrate 161 and the cleaning of the holder contact 204 can be synchronized, and the blow of the substrate 161 and the drying of the holder contact 204 can be synchronized. As a result, the throughput of the plating can be prevented from being reduced. According to this configuration, the cleaning liquid supplying device 403 can be shared between the rinsing bath 114 and the cleaning/drying part 170. Furthermore, according to this configuration, the gas discharge/suction device 405 can be shared between the blowing bath 115 and the cleaning/drying part 170.

Alternatively, the cleaning/drying part 170 having both of the cleaning function and the drying function may be provided to the stocker 130. Since the substrate holder 160 stored in the stocker 130 does not contribute to the plating, this configuration enables the cleaning and the drying to be performed for a long time without reducing the throughput.

Figure 6:
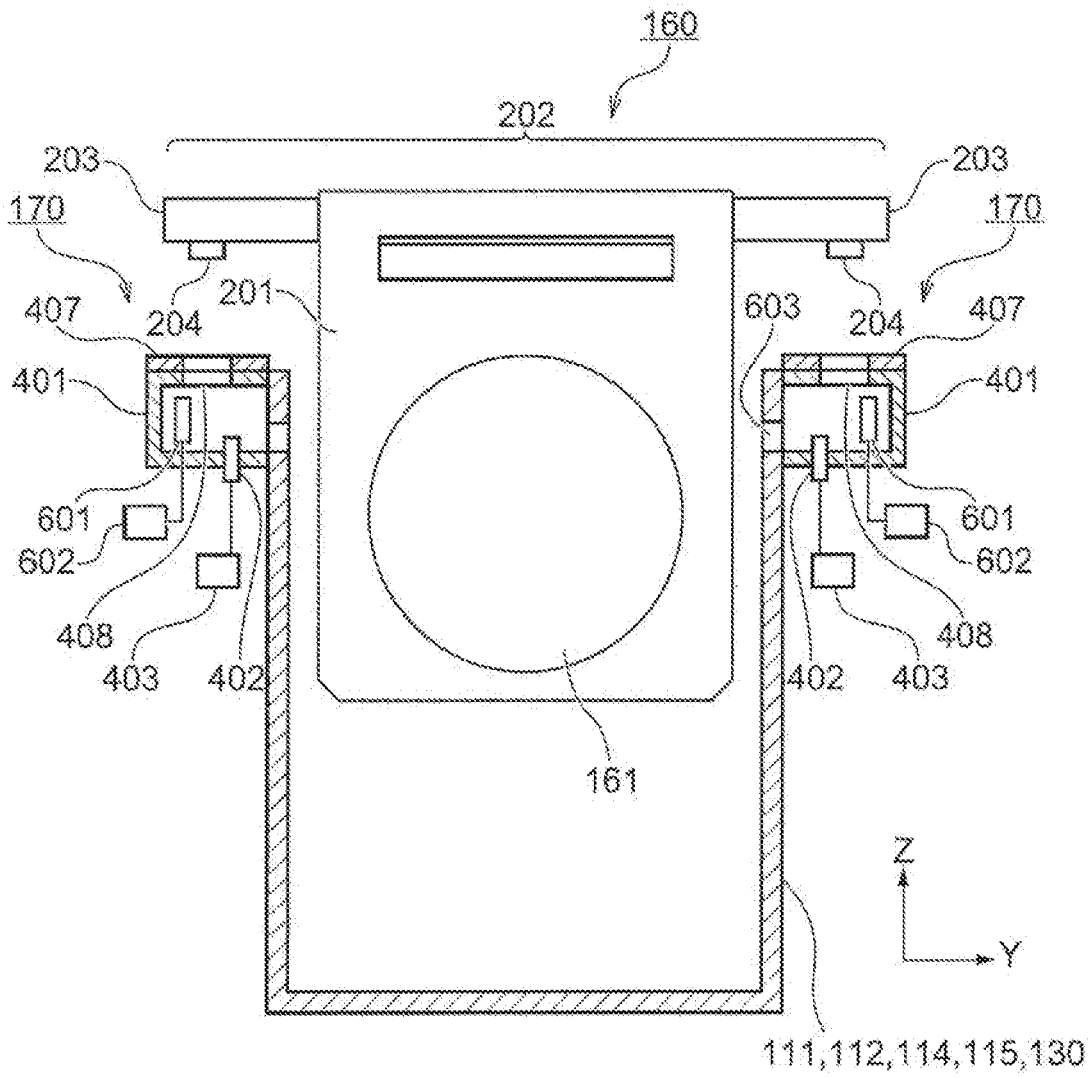
FIG. 6 is an elevational view (partial cross-sectional view) illustrating a bath provided with a cleaning/drying part provided with a heater and for cleaning and/or drying the holder contact.

The configuration of the cleaning/drying part 170 is not limited to the configuration illustrated in FIG. 4. FIG. 6 is an elevational view (partial cross-sectional view) illustrating a bath provided with a cleaning/drying part 170 having different configuration from that of the cleaning/drying part 170 illustrated in FIG. 4. FIG. 6 illustrates a cross-section of the bath and the cleaning/drying part 170. The cleaning/drying part 170 of FIG. 6 includes a heater 601 and a power source 602 instead of the opening 404 for drying and the gas discharge/suction device 405. The cleaning/drying part 170 of FIG. 6 actuates the heater 601 using the power source 602, and heats the holder contact 204, thereby drying the holder contact 204. Furthermore, the cleaning/drying part 170 of FIG. 6 includes a box opening 603 instead of the discharge port 406. The box opening 603 communicates between the cleaning/drying box 401 and the bath. The cleaning liquid in the cleaning/drying box 401 flows into the bath through the box opening 603, and is discharged from a discharge port (not illustrated) provided in the bath.

Figure 7:
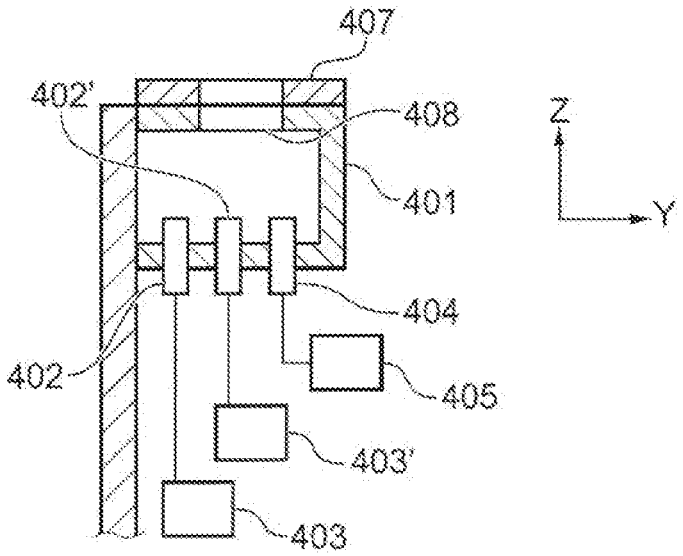
FIG. 7 is an elevational view (partial cross-sectional view) illustrating a part of bath provided with a cleaning/drying part provided with an additional opening for cleaning and an additional cleaning liquid supplying device.

The cleaning/drying part 170 may be provided with a plurality of openings 402 for cleaning and/or the cleaning liquid supplying device 403. FIG. 7 is an elevational view (partial cross-sectional view) illustrating a part of bath provided with a cleaning/drying part 170 provided with an additional opening 402' for cleaning and an additional cleaning liquid supplying device 403'. FIG. 7 illustrates a right portion of the bath. The additional cleaning liquid supplying device 403' may be configured to supply, from the additional opening 402' for cleaning, cleaning liquid having different properties from those of the cleaning liquid supplying device 403. Note that one opening 402 may be shared between the cleaning liquid supplying device 403 and the additional cleaning liquid supplying device 403'.

As one example, the cleaning liquid supplying device 403 may supply arbitrary cleaning liquid (pure water, or the like), and the additional cleaning liquid supplying device 403' may supply a volatile solvent (alcohols, or the like). The volatile solvent is supplied at the end of the cleaning step of the holder contact 204, thereby capable of replacing the cleaning liquid attached to the holder contact 204 with the volatile solvent. The time required in the drying step of the holder contact 204 can be shortened.

As another example, the cleaning liquid supplying device 403 may be configured to supply the etching liquid, and the additional cleaning liquid supplying device 403' may be configured to supply arbitrary cleaning liquid (pure water or the like). It is preferable that the etching liquid reacts with metals in the plating solution 301, and does not influence the holder contact 204 (if the metal in the plating solution is copper, for example, it is preferable that the etching liquid is sulfuric acid/hydrogen peroxide based etching liquid). The etching liquid is supplied in the start of the cleaning step of the holder contact 204, thereby capable of dissolving metals in the droplets 307 attached to the holder contact 204. Thus, the cleaning effect of the holder contact 204 can be enhanced. The etching liquid can be removed from the holder contact 204 by supplying arbitrary cleaning liquid (pure water or the like) after supplying the etching liquid.

The number of openings 402 for cleaning and the number of cleaning liquid supplying devices 403 that are used in one cleaning/drying part 170 are not limited. Three cleaning liquid supplying devices 403 may be provided, and the etching liquid may be supplied at the start of the cleaning step, then the arbitrary cleaning liquid may be supplied, and the volatile solvent may be supplied at the end of the cleaning step.

Second Embodiment

Figure 8A:
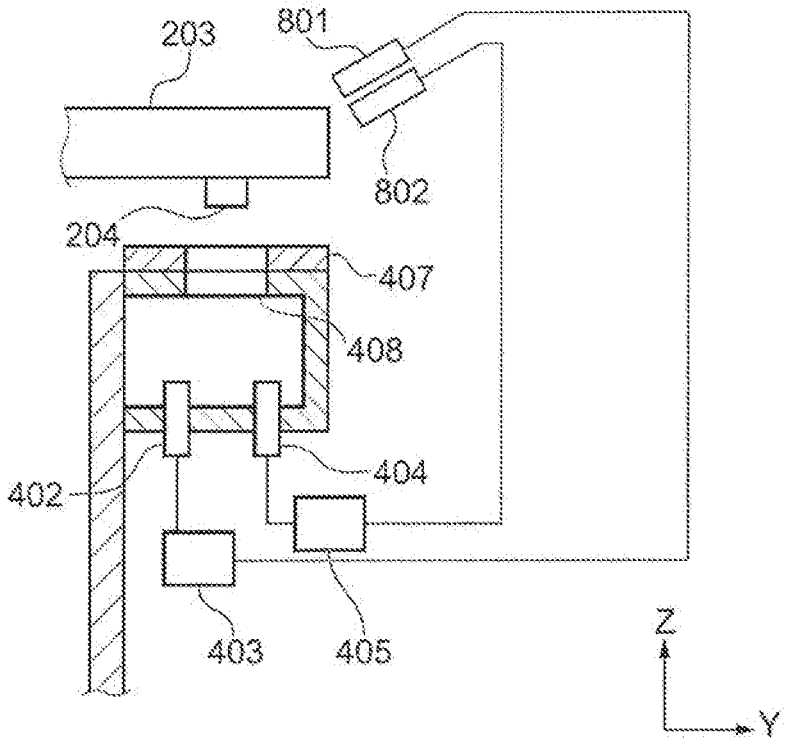
FIG. 8A is an elevational view (partial cross-sectional view) illustrating a part of bath provided with a cleaning/drying part for cleaning or drying a hanger shoulder.
Figure 8B:
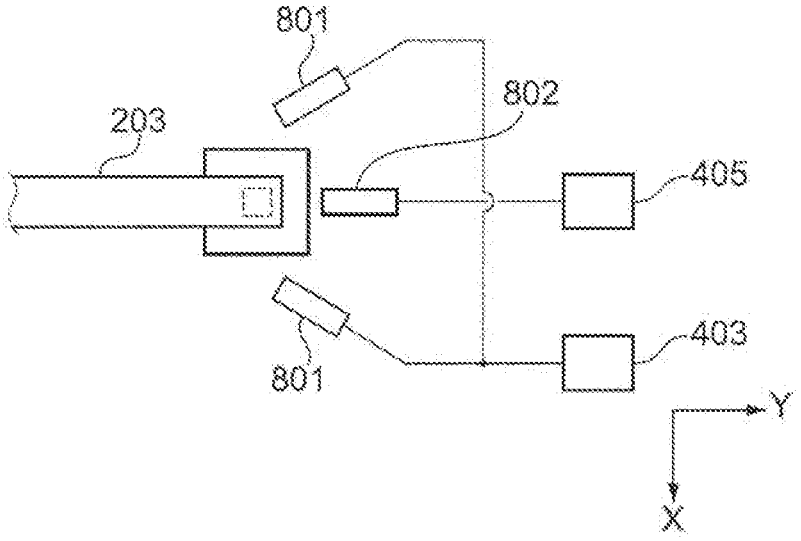
FIG. 8B is a top view illustrating a part of bath illustrated in FIG. 8A.

In a second embodiment, a plating apparatus 100 provided with a cleaning/drying part 170 for cleaning or drying a hanger shoulder 203 will be described. FIG. 8A is an elevational view (partial cross-sectional view) illustrating a part of bath provided with the cleaning/drying part 170 according to the present embodiment. FIG. 8B is a top view illustrating a part of bath illustrated in FIG. 8A. FIG. 8A and FIG. 8B each illustrate a right portion of the bath. The cleaning/drying part 170 according to the present embodiment includes a cleaning nozzle 801 that is connected to the cleaning liquid supplying device 403 and is provided above the hanger shoulder supporter 407, and a drying nozzle 802 that is connected to the gas discharge/suction device 405 and is provided above the hanger shoulder supporter 407, in addition to the configuration of the first embodiment. The cleaning nozzle 801 may be connected not to the cleaning liquid supplying device 403 but to an independent cleaning liquid supplying device. The drying nozzle 802 may be connected not to the gas discharge/suction device 405 but to an independent gas discharge/suction device. If the cleaning of the holder contact 204 is not required (if only the hanger shoulder 203 is cleaned), the cleaning/drying part 170 may include only the cleaning liquid supplying device 403, the gas discharge/suction device 405, the cleaning nozzle 801, and the drying nozzle 802. The cleaning/drying part 170 is provided on at least one side of the pre-cleaning bath 111, the plating bath 112, the rinsing bath 114, and the blowing bath 115. The cleaning/drying part 170 may be provided to the side portion of the stocker 130.

The cleaning nozzle 801 is provided at a position capable of injecting the cleaning liquid toward the hanger shoulder 203 from above the hanger shoulder 203. In other words, the cleaning nozzle 801 is located higher the hanger shoulder 203 when the substrate holder 160 is stored in the bath. The injected cleaning liquid is brought into contact with the hanger shoulder 203 to thereby remove the droplets 307 attached to the hanger shoulder 203, so that the cleaning of the hanger shoulder 203 is achieved. The number of the cleaning nozzles 801 is not limited. As illustrated in FIG. 8B, the cleaning nozzles 801 may be provided on a front (positive direction of the X axis in FIG. 8B) and a back (negative direction of the X axis in FIG. 8B) of the hanger shoulder, respectively.

The drying nozzle 802 is provided at a position capable of injecting the gas (dried air, dry nitrogen or the like) toward the hanger shoulder 203 from above the hanger shoulder 203. In other words, the drying nozzle 802 is located above the hanger shoulder 203 when the substrate holder 160 is stored in the bath. When the drying of the hanger shoulder is not required, it is not required to provide the gas discharge/suction device 405 and the drying nozzle 802. Subsequently to the cleaning of the hanger shoulder 203, the cleaning liquid can be removed from the hanger shoulder 203 by injecting the gas to the hanger shoulder 203 from the drying nozzle 802. The number of drying nozzles 802 is not limited.

The control device 151 may be configured to control the cleaning liquid supplying device that is connected to the cleaning nozzle 801 to automatically clean the hanger shoulder 203. Similarly, the control device 151 may be configured to control the gas discharge/suction device that is connected to the drying nozzle 802 to automatically dry the hanger shoulder 203. A cover (not illustrated) to cover the cleaning nozzle 801 and the hanger shoulder 203 may be provided so that the injected cleaning liquid does not spatter from the cleaning nozzle into the bath. The cover may be provided with a motor that is controlled by the control device 151, so as to be automatically opened or closed.

The cleaning/drying part 170 provided with the cleaning nozzle 801 may be configured to clean and/or dry the hanger shoulder 203 without removing the substrate holder 160 from the plating apparatus. Accordingly, the plating apparatus 100 of the present embodiment can clean the hanger shoulder 203 without reducing the throughput of the plating apparatus, thereby maintaining the hanger shoulder 203 in a cleaned state, and performing the plating in a stable manner. Furthermore, in the plating apparatus 100 of the present embodiment, the time period from attachment of the droplets 307 to cleaning of the hanger shoulder 203 can be shorter as compared with that of the conventional plating apparatus. Both of the cleaning nozzle 801 and the opening 402 for cleaning may be provided, so that both of the hanger shoulder 203 and the holder contact 204 may be cleaned and/or dried. The hanger shoulder 203 may be cleaned by injecting the cleaning liquid toward the hanger shoulder 203 from the opening 402 for cleaning. The cleaning/drying part 170 according to the present embodiment may be provided with a plurality of cleaning liquid supplying devices 403.

When the cleaning/drying part 170 provided with the drying nozzle 802 is provided in the plating bath 112, the attachment of the droplets 307 to the hanger shoulder 203, the holder contact 204, and the plating bath contact 306 can be reduced by the drying nozzle 802. A gas flow from outside to inside of the plating bath 112 (from the portion where the holder contact 204 is to be located to the potion where holding part 201 of the substrate holder 160 is to be located) is generated by injecting the gas from the drying nozzle 802.

When the droplets 307 is assumed to be spattered from the plating solution 301 (when the plating solution is agitated, for example), the control device 151 controls to inject the gas from the drying nozzle 802. The generated gas flow pushes back the droplets 307 into the plating bath 112, thereby preventing the droplets 307 from being attached to the hanger shoulder 203, the holder contact 204, and the plating bath contact 306. Preventing attachment of the droplets 307 by the gas flow is particularly effective when the droplets 307 are shaped like mist. The strength of the gas flow may be appropriately adjusted in accordance with size, generation amount of the droplets 307 or the like.

Third Embodiment

In the cleaning/drying part 170 in the first embodiment, the cleaning liquid may be injected from the lower portion of the cleaning/drying box 401. On the other hand, since a surface of the plating bath contact 306 is directed upward, it is difficult to clean the plating bath contact 306 when the cleaning liquid is injected from the lower portion of the cleaning/drying box 401. If the surfaces of contacts provided to the baths other than the plating bath 112 are directed upward, the similar problem occurs. Thus, in the third embodiment, there will be described a cleaning/drying part 170 for cleaning and/or dry at least the contacts provided to baths.

Figure 9:
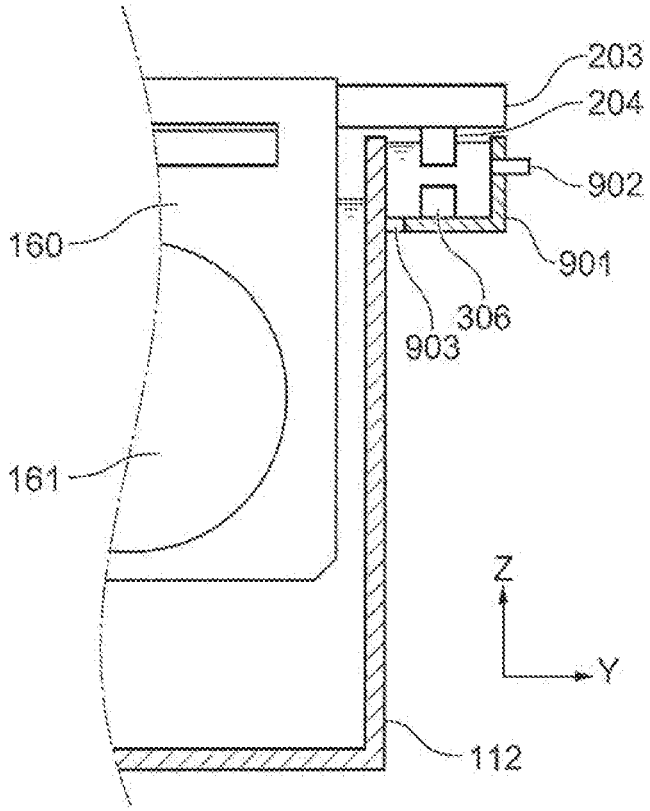
FIG. 9 is an elevational view (partial cross-sectional view) illustrating a part of plating bath provided with a cleaning/drying part for cleaning and/or drying at least plating bath contact.

FIG. 9 is an elevational view (partial cross-sectional view) illustrating a part of plating bath 112 provided with a cleaning/drying part 170 according to the present embodiment. FIG. 9 illustrates a right portion of the plating bath 112. FIG. 9 illustrates a cross-section cut at a position of the plating bath contact 306 regarding the plating bath 112 and the cleaning/drying part 170. Note that the size of the holder contact 204 does not necessarily coincide with the actual size. The cleaning/drying part 170 according to the present embodiment can be applied not only to the plating bath 112, but also to the other baths provided with contacts.

The cleaning/drying part 170 according to the third embodiment includes an outer wall 901, a cleaning liquid supplying device 902, and a discharge port 903. The outer wall 901 is formed around the plating bath contact 306 in the side portion of the plating bath 112, and defines a cleaning space 904 capable of storing and/or passing the cleaning liquid. In other words, the plating bath contact 306 is located inside of the cleaning space 904 that is a space surrounded by the outer wall 901. The cleaning liquid supplying device 902 can supply the cleaning liquid to the cleaning space 904. The discharge port 903 can discharge the cleaning liquid from the cleaning space 904. The cleaning liquid may be discharged from the cleaning space 904 without using the discharge port 903 by configuring the uppermost edge of the outer wall 901 is lower than the uppermost edge of the plating bath 112

The control device 151 controls the lifter 143 for a plating bath to lift the substrate holder 160, so that the holder contact 204 is in a non-contact state with the plating bath contact 306. In this state, it is preferable that the lowermost edge of the holder contact 204 is lower than the uppermost edge of the outer wall 901. Next, the control device 151 controls the cleaning liquid supplying device 902 to supply the cleaning liquid to the cleaning space 904. Since the holder contact 204 is in a non-contact state with the plating bath contact 306, the supplied cleaning liquid can be used to clean the plating bath contact 306. When the lowermost edge of the holder contact 204 is lower than the uppermost edge of the outer wall 901, the cleaning liquid is brought into contact with the holder contact 204, thereby capable of cleaning both of the plating bath contact 306 and the holder contact 204. When the cleaning of the holder contact 204 is not required, the control device 151 may control the cleaning liquid supplying device 902 in a state where the substrate holder 160 is fully lifted.

According to the cleaning/drying part 170 according to the present embodiment, at least the contacts provided to baths can be cleaned immediately after the droplets 307 are attached to each contact of the baths. The cleaning/drying part 170 may be provided with the opening 404 for drying and/or the drying nozzle 802. In the present embodiment, the cleaning liquid is supplied to the cleaning space 904, thereby facilitating the cleaning of the contacts provided to the baths. The cleaning liquid supplying device 902 and the discharge port 903 may be provided at arbitrary positions of the cleaning space 904. By providing the discharge port 903 at a position nearer to the bath than the cleaning liquid supplying device 902, it may be possible to facilitate the discharge of the cleaning liquid that may be mixed into the bath and the prevention of mixing of the cleaning liquid in the bath. The number of the cleaning liquid supplying devices 902 and the number of the discharge ports 903 are not limited.

Figure 10:
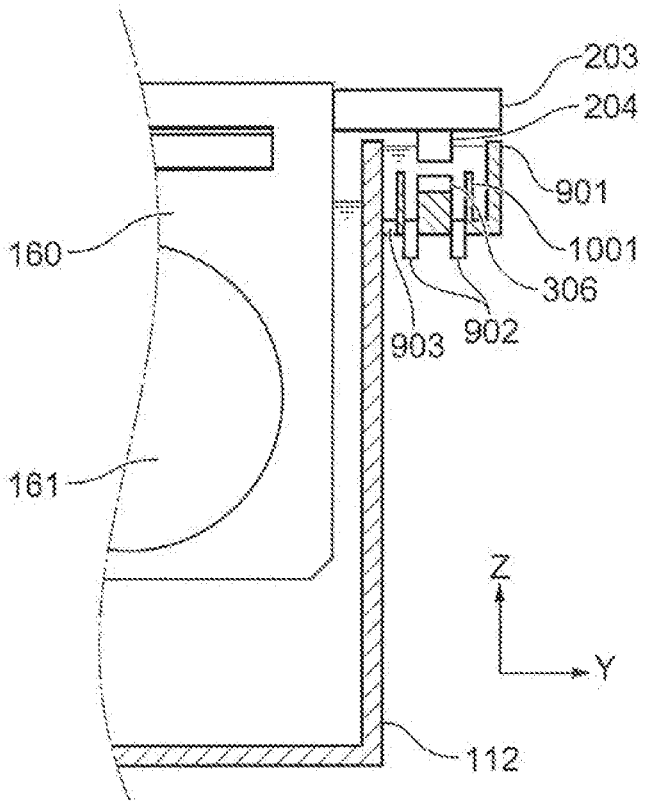
FIG. 10 is an elevational view (partial cross-sectional view) illustrating a part of plating bath provided with a cleaning/drying part provided with an inner wall and for cleaning and/or drying at least plating bath contact.

The cleaning/drying part 170 having a different shape can be adopted. FIG. 10 is an elevational view (partial cross-sectional view) illustrating a part of plating bath 112 provided with a cleaning/drying part 170 provided with an inner wall 1001. FIG. 10 illustrates a right portion of the plating bath 112. The inner wall 1001 is provided in the cleaning space 904. It is preferable that the inner wall 1001 extends to a position higher than the upper edge of the plating bath contact 306 and lower than the upper edge of the outer wall 901. The plating bath contact 306 is provided in the space defined by the inner wall 1001. The cleaning liquid supplying device 902 supplies the cleaning liquid into the space defined by the inner wall 1001, thereby cleaning each contact. The cleaning liquid after cleaning each contact is discharged over the inner wall 1001 and from the discharge port 903 provided in a space defined by the inner wall 1001 and the outer wall 901. This configuration enables the droplets 307 removed from each contact to be prevented from staying in the cleaning space 904.

Figure 11:
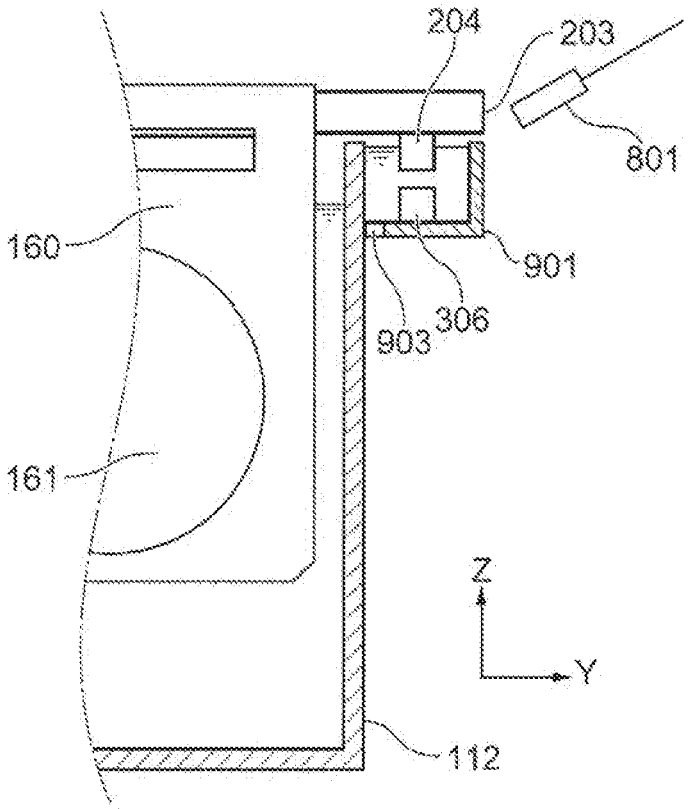
FIG. 11 is an elevational view (partial cross-sectional view) illustrating a part of plating bath provided with a cleaning/drying part provided with a cleaning nozzle and for cleaning and/or drying at least plating bath contact.

The cleaning nozzle 801 can be used instead of the cleaning liquid supplying device 902. FIG. 11 is an elevational view (partial cross-sectional view) illustrating a part of plating bath 112 provided with a cleaning/drying part 170 provided with a cleaning nozzle 801. FIG. 11 illustrates a right portion of the plating bath 112. The cleaning nozzle 801 in the third embodiment is configured to be equivalent to the cleaning nozzle 801 in the second embodiment. The cleaning nozzle 801 injects the cleaning liquid into the cleaning space 904 from above the cleaning space 904, to thereby perform the cleaning of each contact. In this configuration, the cleaning nozzle 801 and the bath can be disposed separately from each other, thereby facilitating the mounting of the cleaning/drying part 170 to the bath.

The gas discharge/suction device 405 or the drying nozzle 802 may be provided to the configurations illustrated in FIG. 9 to FIG. 11 to adopt the configuration for drying the contacts provided to the baths and/or the holder contact 204. The cleaning/drying part 170 according to the present embodiment can be provided with a plurality of cleaning liquid supplying device 403.

Fourth Embodiment

The cleaning liquid may not sometimes flow toward the contacts provided to the baths in the third embodiment. Thus, when the droplets 307 is insoluble in the cleaning liquid or the components in the droplets 307 are fixed onto the contacts, the cleaning efficiency of the contacts provided to the baths may be reduced. In a fourth embodiment, there will be described a cleaning part for cleaning contacts provided to the baths in a configuration different from that of the third embodiment.

Figure 12:
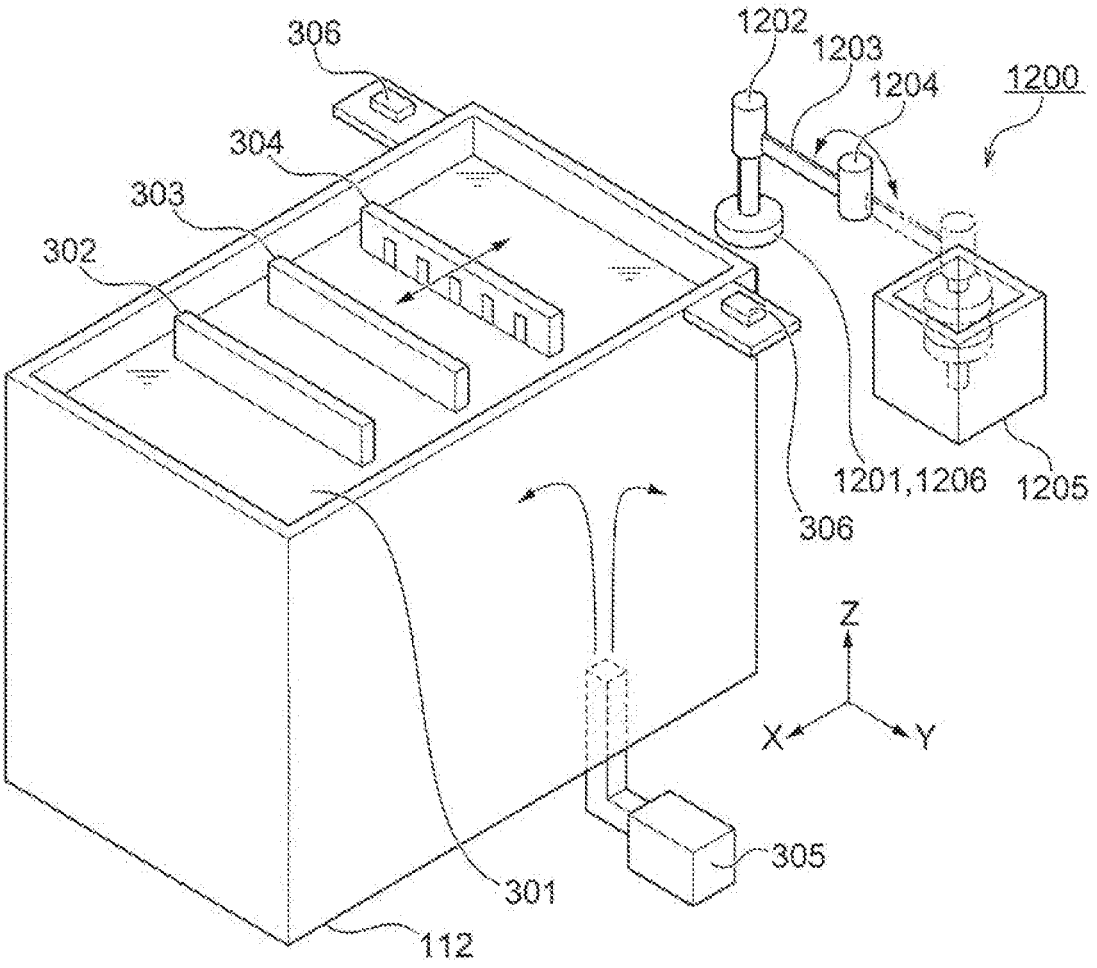
FIG. 12 is a perspective view illustrating a plating bath provided with a cleaning part for cleaning a plating bath contact.

FIG. 12 is a perspective view illustrating a plating bath 112 provided with a cleaning part 1200 according to the present embodiment. The cleaning/drying part 170 according to the present embodiment can be applied not only to the plating bath 112, but also to the other baths provided with contacts. The cleaning part 1200 in FIG. 12 is provided separately from a right portion of the plating bath 112, and includes a cleaning head 1201, a head vertical movement mechanism 1202, an arm 1203, an arm rotating mechanism 1204, and a head cleaning part 1205. The arm rotating mechanism 1204 provided at one end of the arm 1203 is configured to rotate the arm 1203 and move (revolve) the cleaning head 1201 provided to the other end of the arm 1203. The cleaning head 1201 can be located above the plating bath contact 306 and above the head cleaning part 1205 by the rotation of the arm 1203. The head cleaning part 1205 is preferably provided separately from the plating bath 112. The cleaning part 1200 may be provided on both of left and right of the plating bath 112. A cover (not illustrated) may be provided around the cleaning head 1201 to prevent the liquid from spattering from the cleaning head 1201.

In the cleaning part 1200 in FIG. 12, the cleaning head 1201 is pressed against the plating bath contact 306 by means of the head vertical movement mechanism 1202. The droplets 307 are absorbed in the cleaning head 1201 or wiped off by the cleaning head 1201 to thereby clean the plating bath contact 306. A motor 1206 is incorporated in the cleaning head 1201, so that the cleaning head 1201 can be rotated (be spun) by the motor 1206 during the cleaning of the plating bath contact 306, thereby enhancing the cleaning effect. In this case, it is preferable that the circular cleaning head 1201 is used. As another method, an arm expandable mechanism may be incorporated in the arm 1203, so that the cleaning head 1201 can be horizontally moved, thereby enhancing the cleaning effect. In this case, the cleaning head 1201 may be shaped like a blade (wiper). The plating bath contact 306 may be cleaned by combining both of the rotation and the horizontal movement of the cleaning head 1201.

After the plating bath contact 306 is cleaned, the control device 151 controls the head vertical movement mechanism 1202 and the arm rotating mechanism 1204, to thereby move the cleaning head 1201 into the head cleaning part 1205 and clean the cleaning head 1201. The droplets 307 absorbed in the cleaning head 1201 can be removed by this cleaning of the cleaning head 1201. When the cleaning head 1201 is replaceable, the head cleaning part 1205 may not be provided. When the cleaning head 1201 is replaceable, it is preferable that the cleaning head 1201 is replaced after the plating bath contact 306 is cleaned a predetermined number of times.

Figure 13:
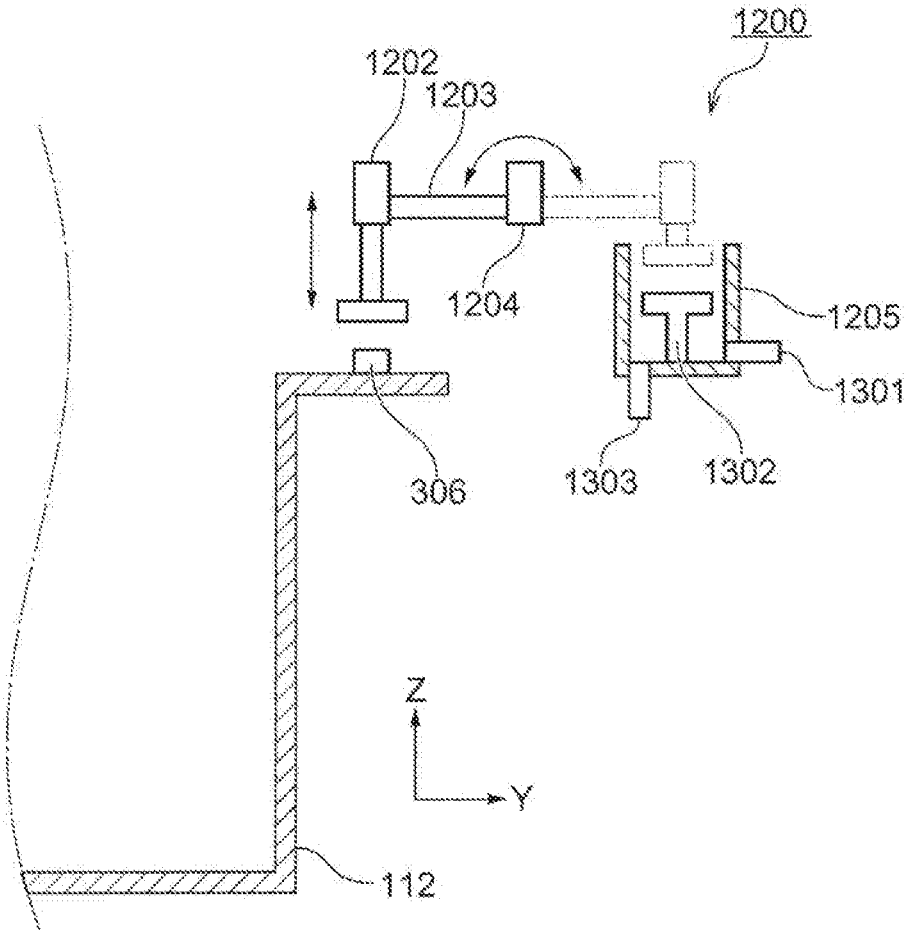
FIG. 13 is an elevational view of a cleaning part for cleaning a plating bath contact.

FIG. 13 is a schematic elevational view illustrating the cleaning part 1200 according to the present embodiment. The head cleaning part 1205 includes a cleaning liquid supplying device 1301, a cleaning table 1302, and a discharge port 1303. The cleaning liquid supplying device 1301 supplies the cleaning liquid to the head cleaning part 1205, and the discharge port 1303 discharges the cleaning liquid from the head cleaning part. The head vertical movement mechanism 1202 can press the cleaning head 1201 against the cleaning table 1302. When the cleaning head 1201 is pressed against the cleaning table 1302 in a state where the cleaning liquid is filled in the head cleaning part 1205 (filled up to at least the upper portion of the cleaning table 1302), the cleaning head 1201 is cleaned. When the cleaning head 1201 is pressed against the cleaning table 1302 in a state where the cleaning liquid is discharged from the head cleaning part 1205 (up to at least the lower portion of the cleaning table 1302), the moisture of the cleaning head 1201 is removed. The cleaning part 1200 may be provided with a plurality of cleaning liquid supplying devices 1301.

The shape of the cleaning table 1302 is arbitrary (circular or square, for example), but it is preferable that the cleaning table 1302 is larger than the cleaning head 1201. The mesh-like cleaning table 1302 can be used to increase the moisture removal capacity.

Figure 14:
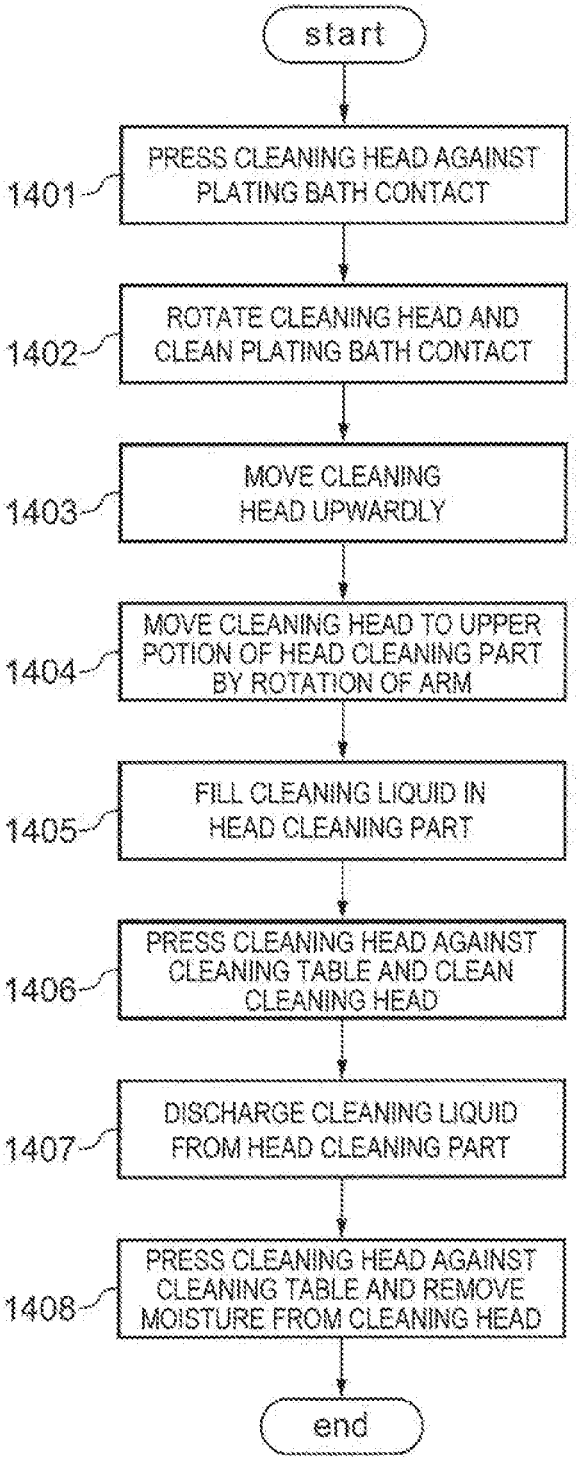
FIG. 14 is a flowchart illustrating a control method for a cleaning part for cleaning a plating bath contact.

FIG. 14 is a flowchart illustrating a method of using the cleaning part 1200 according to the present embodiment. Before the start of the control, the cleaning head 1201 is located above the plating bath contact 306, and the cleaning liquid is not filled in the head cleaning part 1205.

Step 1401: The control device 151 controls head vertical movement mechanism 1202 to press the cleaning head 1201 against the plating bath contact 306.

Step 1402: The control device 151 controls the motor 1206 to rotate the cleaning head 1201. The plating bath contact 306 is cleaned in Step 1402.

Step 1403: The control device 151 controls the head vertical movement mechanism 1202 to move the cleaning head 1201 upwardly (release the pressing of the cleaning head 1201 against the plating bath contact 306).

Step 1404: The control device 151 controls the arm rotating mechanism 1204 to move the cleaning head 1201 to the upper portion of the head cleaning part 1205.

Step 1405: The control device 151 controls the cleaning liquid supplying device 1301 to fill the cleaning liquid in the head cleaning part 1205.

Step 1406: The control device 151 controls the head vertical movement mechanism 1202 to press the cleaning head 1201 against the cleaning table 1302 once or a plurality number of times and clean the cleaning head 1201.

Step 1407: The control device 151 controls the discharge port 1303 to discharge the cleaning liquid from the head cleaning part 1205.

Step 1408: The control device 151 controls the head vertical movement mechanism 1202 to press the cleaning head 1201 against the cleaning table 1302 once or a plurality number of times and remove the moisture from the cleaning head 1201.

The above-described flowchart is exemplified, and the steps may be changed, added, or deleted. For example, the plating bath contact 306 may be cleaned only by pressing the cleaning head 1201 against the plating bath contact 306 without rotating the cleaning head 1201 in Step 1402. The cleaning head 1201 may be cleaned in step 1406 or the moisture may be removed from the cleaning head 1201 in step 1408 by rotating the cleaning head 1201 by a motor without pressing the cleaning head 1201 against the cleaning table 1302. In this case, it is not required to provide the cleaning table 1302 in the head cleaning part 1205. The other changes may be made in the flowchart without departing from the spirit of the present invention.

The cleaning head 1201 may be combined with the cleaning/drying part 170 provided with the cleaning nozzle 801 illustrated in FIG. 11. In this case, the amount of cleaning liquid with respect to adhesion amount of droplets 307 can be increased, the dilution degree of the droplets 307 can be increased, and the cleaning efficiency can be improved.

In the electroplating apparatus of the present embodiment, the cleaning head 1201 can be physically brought into contact with the contact provided to the bath, to thereby clean the contact provided to the bath. Therefore, the cleaning efficiency of the contact provided with the bath can be improved.

In the electroplating apparatus of the present embodiment, the cleaning part 1200 can be disposed separately from the side of the bath. This configuration enables the flexibility of the arrangement of piping to be improved. This configuration enables the cleaning part to be disposed even to the plating bath that is difficult to dispose the cleaning/drying part in the other embodiment.

Although some embodiments of the present invention have been described above, the above-described embodiments of the present invention are intended to facilitate understanding of the present invention, and do not limit the present invention. Various changes and improvements can be made to the present invention without departing from the scope of the invention, and the present invention includes equivalents thereof. Further in a range capable of solving at least a part of the problems described above or in a range of producing at least a part of effects described above, respective constituent elements claimed in the scope of claims and described in the specification can be arbitrarily combined with each other or can be arbitrarily omitted.

The present application discloses, as one embodiment, an electroplating apparatus for plating a substrate using a substrate holder, the electroplating apparatus comprising at least one bath for storing the substrate and/or the substrate holder, the substrate holder being provided with a hanger shoulder, and a holder contact, and the electroplating apparatus being provided with a cleaning/drying part provided on at least one side of the bath, the cleaning/drying part being provided for cleaning and/or drying at least one of the hanger shoulder, the holder contact and a contact provided to the bath.

Furthermore, the present application discloses, as one embodiment, a cleaning method in an electroplating apparatus for plating a substrate using a substrate holder, the electroplating apparatus comprising at least one bath for storing the substrate, the substrate holder being provided with a hanger shoulder, and a holder contact, wherein the method comprises cleaning the at least one of the hanger shoulder, the holder contact and a contact provided to the bath by a cleaning/drying part provided on a side of the bath.

The electroplating apparatus and the cleaning method in the electroplating apparatus can produce effects capable of cleaning each component without reducing the throughput of the plating apparatus, as one example.

Furthermore, the present application discloses, as one embodiment, an electroplating apparatus comprising: a plating bath provided with a plating bath contact; and a cleaning part for cleaning the plating bath contact, the cleaning part including: a cleaning head; and a head vertical movement mechanism that vertically moves the cleaning head and presses the plating bath contact against the cleaning head.

Furthermore, the present application discloses, as one embodiment, a cleaning method in an electroplating apparatus, the electroplating apparatus comprising: a plating bath provided with a plating bath contact; and a cleaning part for cleaning the plating bath contact, and wherein the method comprises cleaning the plating bath contact by pressing a cleaning head of the cleaning part provided in the electroplating apparatus against the plating bath contact.

The electroplating apparatus and the cleaning method in the electroplating apparatus can produce effects capable of enhancing the cleaning efficiency of the plating bath contact by cleaning the plating bath contact by being physically brought into contact with the cleaning head.

REFERENCE SIGNS LIST

100 . . . electroplating apparatus
110 . . . bath (bath group)
111 . . . pre-cleaning bath
112 . . . plating bath
113 . . . overflow bath
114 . . . rinsing bath
115 . . . blowing bath
120 . . . transport mechanism
121 . . . transport guide
122 . . . transport arm
123 . . . holder gripping mechanism
130 . . . stocker
140 . . . lifter group
141 . . . lifter for stocker
142 . . . lifter for pre-cleaning bath
143 . . . lifter for plating bath
144 . . . lifter for rinsing bath
145 . . . lifter for blowing bath
146 . . . lifter arm
147 . . . receiver
148 . . . lifter guide
150 . . . control part
151 . . . control device
152 . . . storage device
153 . . . input device
160 . . . substrate holder
161 . . . substrate
170 . . . cleaning/drying part
201 . . . holding part
202 . . . hanger part
203 . . . hanger shoulder
204 . . . holder contact
205 . . . conductive wire
301 . . . plating solution
302 . . . anode
303 . . . regulation plate
304 . . . paddle
305 . . . circulation pump
306 . . . plating bath contact
307 . . . droplet
401 . . . cleaning/drying box
402 . . . opening for cleaning
403 . . . cleaning liquid supplying device
404 . . . opening for drying
405 . . . gas discharge/suction device
406 . . . discharge port
407 . . . hanger shoulder supporter
408 . . . upper opening
501 . . . supporter opening
502 . . . packing
601 . . . heater
602 . . . power source
603 . . . box opening
801 . . . cleaning nozzle
802 . . . drying nozzle
901 . . . outer wall
902 . . . cleaning liquid supplying device
903 . . . discharge port
904 . . . cleaning space
1001 . . . inner wall
1200 . . . cleaning part
1201 . . . cleaning head
1202 . . . head vertical movement mechanism
1203 . . . arm
1204 . . . arm rotating mechanism
1205 . . . head cleaning part
1206 . . . motor
1301 . . . cleaning liquid supplying device
1302 . . . cleaning table
1303 . . . discharge port

What is claimed is:

1. An electroplating apparatus (100) for plating a substrate (161) using a substrate holder (160), the electroplating apparatus (100) comprising:

at least one bath (110, 112) for storing the substrate holder (160), wherein the substrate holder (160) is provided with a hanger shoulder (203) having a holder contact (204) configured to contact with a contact (306) of the bath (110, 112), and wherein the electroplating apparatus (100) is provided with a cleaning/drying part (170) provided on at least one side of the bath (110, 112), the cleaning/drying part (170) being provided for cleaning and/or drying at least one of the hanger shoulder (203), or the holder contact (204), wherein the cleaning/drying part is separate from the bath, and wherein the cleaning/drying part (170) is provided with a cleaning/drying box (401), and wherein the cleaning/drying box (401) comprises:

a first opening (402) for cleaning;

a first cleaning liquid supplying device (403) for supplying a cleaning liquid into the cleaning/drying box (401) through the first opening (402) for cleaning;

a second opening (404) for drying; and a gas discharge/suction device (405) for discharging or sucking a gas to/from an inside of the cleaning/drying box (401) through the opening (404) for drying.

2. The electroplating apparatus (100) according to claim 1, wherein the cleaning/drying box (401) has an upper opening (408) at a position corresponding to that of the holder contact (204) when the substrate holder (160) is stored in the bath (110, 112), and wherein the first opening (402) for cleaning is a cleaning nozzle configured to inject the cleaning liquid toward the upper opening (408).

3. The electroplating apparatus (100) according to claim 1, wherein the cleaning/drying box (401) has an upper opening (408) at a position corresponding to that of the holder contact (204) when the substrate holder (160) is stored in the bath (110, 112), and wherein the first opening (402) for cleaning is provided at a portion lower than the upper opening (408).

4. The electroplating apparatus (100) according to claim 1, wherein the cleaning/drying box (401) is provided with a second cleaning liquid supplying device (403'), and wherein a cleaning liquid supplied by the second cleaning liquid supplying device (403') is different from that supplied by the first cleaning liquid supplying device (403).

5. The electroplating apparatus (100) according to claim 1, wherein the bath (110, 112) includes a contact (306), the holder contact (204) is configured to contact with the contact (306) of the bath (110, 112), and the cleaning/drying part (170) is configured to clean and dry at least one of the hanger shoulder (203), the holder contact (204), and the contact (306) of the bath (110, 112).

6. An electroplating apparatus (100) for plating a substrate (161) using a substrate holder (160), the electroplating apparatus (100) comprising:

at least one bath (110, 112) for storing the substrate holder (160), the bath (110, 112) including a contact (306), wherein the substrate holder (160) is provided with a hanger shoulder (203) having a holder contact (204) configured to contact with the contact (306) of the bath (110, 112), and wherein the electroplating apparatus (100) is provided with a cleaning/drying part (170) provided on at least one side of the bath (110, 112), the cleaning/drying part (170) being configured to clean and/or dry at least one of the hanger shoulder (203), the holder contact (204) or the contact (306) of the bath (110, 112), wherein the cleaning/drying part is separate from the bath, and wherein the cleaning/drying part (170) is provided with a cleaning nozzle (801) configured to inject the cleaning liquid toward the hanger shoulder (203), the cleaning nozzle (801) being located above the position where the hanger shoulder (203) is to be located when the substrate holder (160) is stored in the bath (110, 112).

7. An electroplating apparatus (100) comprising:

a plating bath (112) provided with a plating bath contact (306);

a substrate holder (160) provided with a hanger shoulder (203) having a holder contact (204) configured to be contacted with the plating bath contact (306); and a cleaning part (1200) for cleaning the plating bath contact (306), wherein the cleaning part (1200) includes:

a cleaning head (1201);

a head cleaning part (1205) configured to clean the cleaning head (1201), the head cleaning part (1205) including a cleaning table (1302); and a head vertical movement mechanism (1202) that vertically moves the cleaning head (1201) and presses the cleaning head (1201) against the plating bath contact (306), and presses the cleaning head (1201) against the cleaning table (1302).

* * * * *